US011193314B2

(12) United States Patent
Kang

(10) Patent No.: US 11,193,314 B2
(45) Date of Patent: Dec. 7, 2021

(54) EMERGENCY ESCAPE APPARATUS FOR A BUILDING

(71) Applicant: Hoyoung Kang, Barrigada, GU (US)

(72) Inventor: Hoyoung Kang, Barrigada, GU (US)

( * ) Notice: Subject to any disclaimer, the term of this patent is extended or adjusted under 35 U.S.C. 154(b) by 436 days.

(21) Appl. No.: 16/223,210

(22) Filed: Dec. 18, 2018

(65) Prior Publication Data

US 2019/0338570 A1 Nov. 7, 2019

(30) Foreign Application Priority Data

May 3, 2018 (KR) ..... 10-2018-0051384

(51) Int. Cl.
*E05C 9/08* (2006.01)
*E05C 9/10* (2006.01)
*E06B 5/16* (2006.01)

(52) U.S. Cl.
CPC ..... *E05C 9/085* (2013.01); *E05C 9/10* (2013.01); *E06B 5/162* (2013.01); *E05Y 2201/638* (2013.01); *E05Y 2201/686* (2013.01); *E05Y 2400/30* (2013.01); *E05Y 2800/11* (2013.01); *E05Y 2800/252* (2013.01); *E05Y 2900/134* (2013.01)

(58) Field of Classification Search
CPC ..... Y10T 292/694; E05C 9/085; E05C 9/10; E05C 9/00; E05C 9/02; E05C 9/04; E05C 9/24; E05C 19/028; E06B 5/162; E05Y 2201/638; E05Y 2201/686; E05Y 2400/30; E05Y 2800/11; E05Y 2800/252; E05Y 2900/134; E05B 15/04; E05B 15/101; E05B 17/0037; E05B 63/20
USPC ..... 292/32, 33, 37, 42, 137, 138, 163, 164, 292/169, 175, DIG. 65; 70/92, 465, 70/278.7, 279.1, 282; 109/59 R, 59 T
See application file for complete search history.

(56) References Cited

U.S. PATENT DOCUMENTS 1,118,435 A * 11/1914 Pelaez ..... E05G 1/00 109/59 R
1,564,729 A * 12/1925 Von Schrenk ..... E05B 65/005 292/164
1,896,203 A * 2/1933 Rosatelli ..... E05D 15/502 16/230

(Continued)

FOREIGN PATENT DOCUMENTS

DE 3926163 A1 * 2/1991 ..... E05B 47/0002
DE 20213559 U1 * 1/2004 ..... E05D 15/526

(Continued)

*Primary Examiner* — Kristina R Fulton
*Assistant Examiner* — Steven A Tullia
(74) *Attorney, Agent, or Firm* — Fish & Richardson P.C.

(57) ABSTRACT

An emergency escape apparatus includes a support frame that is configured to be installed on a door or a wall and that defines an exit opening, an escape door that is located at an inner side of the exit opening and configured to open and close the exit opening and that defines an accommodation space, a driving unit located in the accommodation space and configured to rotate relative to the escape door, and an unlocking device that is located in the accommodation space, that is configured to be pushed by the driving unit, and that is configured to release coupling between the escape door and the support frame based on rotation of the driving unit. The driving unit is configured to be controlled by a control unit based on a sensor detecting an event.

20 Claims, 8 Drawing Sheets

(56) References Cited

U.S. PATENT DOCUMENTS 2,278,318 A * 3/1942 Jenkins ..... E05C 9/10 114/117
2,355,025 A * 8/1944 Arthur ..... E05C 9/14 292/45
2,392,874 A * 1/1946 Pelaez ..... E05C 9/046 292/36
2,489,957 A * 11/1949 Davis ..... E05C 9/046 292/33
4,534,192 A * 8/1985 Harshbarger ..... E05B 63/20 109/59 R
4,614,902 A * 9/1986 Jessup ..... H02P 7/03 318/282
4,621,845 A * 11/1986 Vanago ..... E05C 19/001 292/37
5,470,115 A * 11/1995 Berg ..... E05B 63/20 292/335
5,852,944 A * 12/1998 Collard, Jr. ..... E05B 47/026 70/278.7
7,387,076 B2 * 6/2008 Bauman ..... E05B 17/2038 109/59 R
2004/0183677 A1 * 9/2004 Fitzgibbon ..... E05F 15/72 340/540
2005/0193932 A1 * 9/2005 Denison ..... E05G 1/04 109/59 R
2006/0117878 A1 * 6/2006 Spurr ..... E05B 81/25 74/49
2007/0124893 A1 * 6/2007 Brustle ..... E05F 5/02 16/296
2011/0174025 A1 * 7/2011 Rasmussen ..... E05B 53/00 70/91
2014/0110953 A1 * 4/2014 Leib ..... E05C 9/10 292/263
2015/0262438 A1 * 9/2015 Zasowski ..... G06F 3/0482 340/5.51
2017/0321457 A1 * 11/2017 Battenfield ..... E05C 9/06

FOREIGN PATENT DOCUMENTS

DE 202014010437 U1 * 8/2015 ..... E05B 47/026
FR 2758359 A1 * 7/1998 ..... E05B 63/0021
GB 2262763 A * 6/1993 ..... E05C 9/16
KR 200182344 B1 5/2000
KR 101693353 B1 1/2017
WO WO-0030931 A1 * 6/2000 ..... E05B 83/01
WO WO-2005069723 A2 * 8/2005 ..... E05C 19/166

* cited by examiner

EMERGENCY ESCAPE APPARATUS FOR A BUILDING

CROSS-REFERENCE RELATED APPLICATIONS

This application claims the benefit of an earlier filing date and priority to Korean Application No. 10-2018-0051384, filed on May 3, 2018, the contents of which are incorporated by reference herein in its entirety.

TECHNICAL FIELD

The present disclosure relates to an emergency escape apparatus for a building and, more specifically, an emergency escape apparatus including a latching device configured to release coupling between an escape door and a support frame to allow people to escape from the building in an event of a building fire.

BACKGROUND

In an event of a fire at a building such as a shopping arcade, people may escape through stairs, corridors, or elevators.

In some cases, when the escape routes through stairs or elevators may be unavailable due to the flame, people may use an emergency exit, for example, located at an end of the corridor of each floor to escape from the building through outer emergency stairs.

In some cases, the emergency exit may be locked, for example, to prevent an intrusion into the building or due to lack of the outer emergency stairs. In such cases, the emergency exit may be an obstacle that delays escape from the building in an event.

SUMMARY

The present disclosure provides an emergency escape apparatus that can be installed at a door of a building such as an emergency exit door or at a part of a building wall and that enables people to quickly escape from the building.

According to one aspect of the subject matter described in this application, an emergency escape apparatus includes a support frame configured to be installed on a door or a wall, where the support frame defines an exit opening, an escape door located at an inner side of the exit opening and configured to open and close the exit opening, where the escape door defining an accommodation space, a driving unit located in the accommodation space of the escape door and configured to rotate relative to the escape door, and an unlocking device that is located in the accommodation space of the escape door, that is configured to be pushed by the driving unit, and that is configured to release coupling between the escape door and the support frame based on rotation of the driving unit. The driving unit is configured to be controlled by a control unit based on a sensor detecting an event such as a fire at a building.

Implementations according to this aspect may include one or more of the following features. For example, the unlocking device may include a first unlocking part located at an upper side of the driving unit and a second unlocking part located at a lower side of the driving unit. The first unlocking part may include: a first pushing rod that extends in an upward direction from the upper side of the driving unit and that is configured to move upward based on being pushed by the upper side of the driving unit; a first latching rod configured to move downward to be released from the support frame based on the first pushing rod moving upward; a first link assembly that connects the first pushing rod and the first latching rod to each other; and a first spring that connects the escape door and the first link assembly to each other. The second unlocking part may include: a second pushing rod that extends in a downward direction from the lower side of the driving unit and that is configured to move downward based on being pushed by the lower side of the driving unit; a second latching rod configured to move upward to be released from the support frame based on the second pushing rod moving downward; a second link assembly that connects the second pushing rod and the second latching rod to each other; and a second spring that connects the escape door and the second link assembly to each other.

In some implementations, the first latching rod may include a pair of first latching rods that are located at a first lateral side and a second lateral side with respect to the first pushing rod, respectively, the pair of first latching rods being configured to move downward together based on the first pushing rod moving upward. The second latching rod may include a pair of second latching rods that are located at the first lateral side of the second pushing rod and the second lateral side with respect to the second pushing rod, the pair of second latching rods being configured to move upward together based on the second pushing rod moving downward.

In some examples, the first link assembly may include: a pair of first pushing links, where each of the pair of first pushing links has a first end connected to an upper end of the first pushing rod; a pair of first connection links, where each of the pair of first connection links is configured to rotate about a first hinge axis positioned at a rear cover of the escape door, and has a first end connected to a second end of one of the pair of first pushing links; and a pair of first latching links, where each of the pair of first latching links has a first end connected to the first end of one of the pair of first connection links, and a second end connected to a lower end of one of the pair of first latching rods. The second link assembly may include: a pair of second pushing links, where each of the pair of second pushing links has a first end connected to a lower end of the second pushing rod; a pair of second connection links, where each of the pair of second connection links is configured to rotate about a second hinge axis positioned at the rear cover of the escape door, and has a first end connected to a second end of one of the pair of second pushing links; and a pair of second latching links, where each of the pair of second latching links has a first end connected to the first end of one of the pair of second connection links, and a second end connected to an upper end of one of the pair of second latching rods.

In some implementations, the driving unit may include a rotating piece rotatably coupled to the escape door, where the rotating piece includes a cam that is located at an outer circumference of the rotating piece and that protrudes in one or more directions from the outer circumference of the rotating piece; a drive motor connected to the control unit and configured to rotate the rotating piece; and a power transmission unit that connects the drive motor to the rotating piece. In some examples, the cam of the rotating piece is configured to push both of the first pushing rod and the second pushing rod simultaneously. In some examples, the escape door may include a front cover that faces an interior area, and the front cover includes a handle located at a front surface of the front cover and an access part that allows a user to access the handle to rotate the driving unit.

In some implementations, the emergency escape apparatus may include one or more wires that connect the escape door and the support frame to each other. In some examples, the rotating piece has an oval shape that contacts a lower end of the first pushing rod and an upper end of the second pushing rod. In some cases, the rotating piece may be located between the lower end of the first pushing rod and the upper end of the second pushing rod.

In some implementations, the power transmission unit may include a worm gear connected to the drive motor. In some examples, the driving unit is configured to rotate about a rotation shaft located at the rear cover of the escape door. In some implementations, the emergency escape apparatus includes the control unit and the sensor that is connected to the control unit. In other implementations, the control unit and the sensor are installed at a building, and the driving unit is configured to communicate with the control unit.

In some examples, the first unlocking part and the second unlocking part may be symmetric with respect to a line passing through a center of the driving unit. In some examples, the sensor may include a fire detector, a gas detector, a temperature sensor, or a camera.

DETAILED DESCRIPTION

Figure 1:
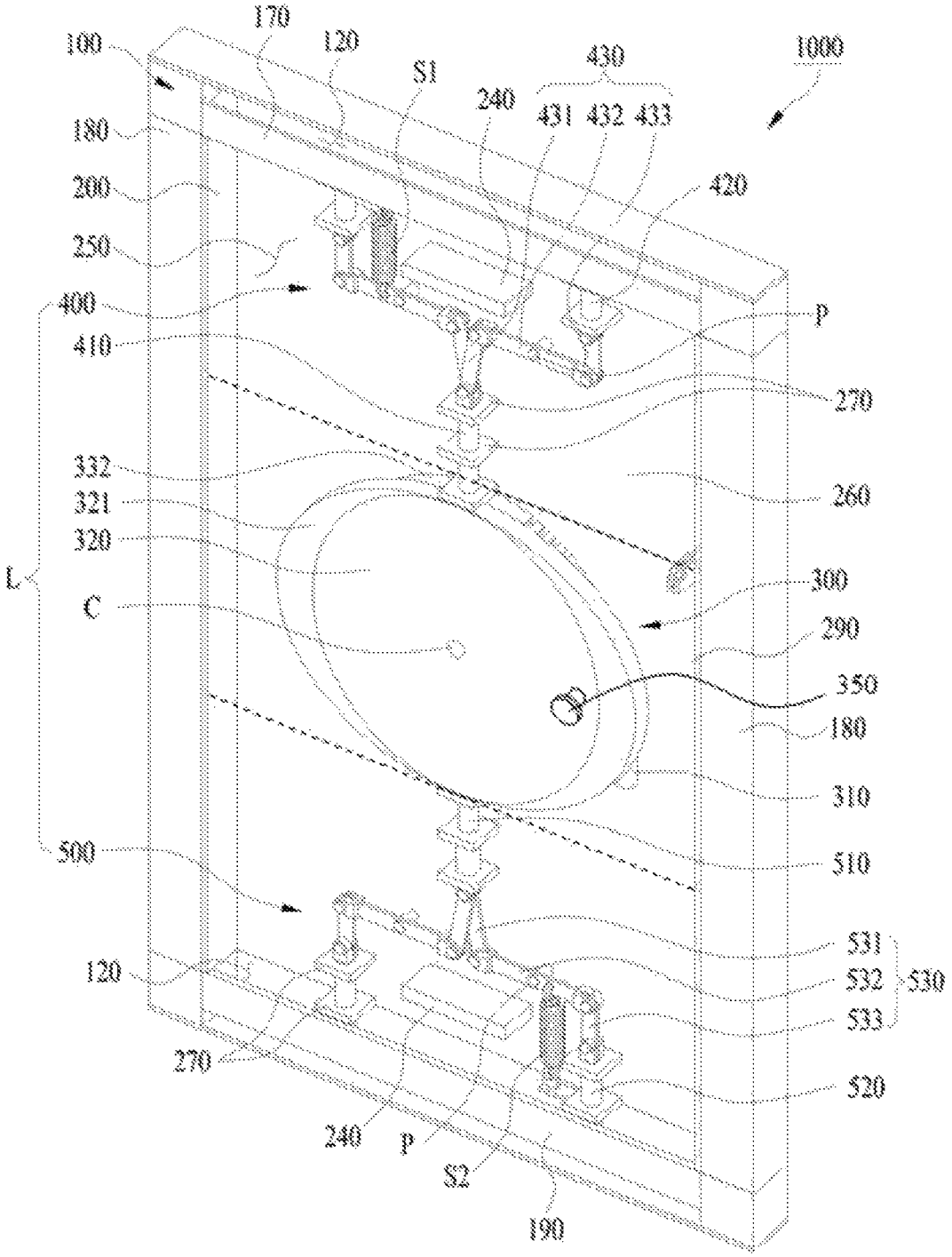
FIG. 1 is a perspective view illustrating an example emergency escape apparatus.

Hereinafter, one or more implementations of an example emergency escape apparatus are described with reference to attached FIGS. 1 to 8 and explained in detail with examples.

Referring to FIGS. 1 to 8, an emergency escape apparatus 1000 includes a support frame 100 that defines an exit opening 110, and an escape door 200 located at an inner side of the exit opening 110 and configured to close and open the exit opening 110, where the escape door 200 defines an accommodation space 250 in the escape door 200. The emergency escape apparatus 1000 further includes a driving unit 300 located in the accommodation space 250 and configured to rotate to release coupling between the escape door 200 and the support frame 100, and an unlocking device L that is located in the accommodation space 250 of the escape door 200, that is configured to be pushed by the driving unit 300, and that is configured to release coupling between the escape door 200 and the support frame 100 based on rotation of the driving unit 300. In some examples, the emergency escape apparatus 1000 may further include a fire detection unit 550 configured to detect fire and a control unit 600 connected to the driving unit 300. In some implementations, at least one of the fire detection unit 550 or the control unit 600 is spaced apart from the emergency escape apparatus 1000 and provided at a building, and the driving unit 300 may communicate with the fire detection unit 550 or the control unit 600. In some examples, the driving unit 300 may be configured to rotate about an axis that passes a front or rear surface of the escape door 200.

In some implementations, the fire detection unit 550 may detect an event such as a fire in the building and transmit a detection signal to the control unit 600, and the control unit 600 may transmit a driving signal to the driving unit 300 based on the detection signal.

When the driving unit 300 is rotated according to the transmitted driving signal, a portion of the driving unit 300 may push the unlocking part L so that the escape door 200 is released from the support frame 100.

The driving unit 300 may be installed within the accommodation space 250 of the escape door 200, and may include a drive motor 310 connected to the control unit 600, a rotating piece 320 including a cam 321 on an outer surface thereof, and a power transmission unit 330 that connects the drive motor 310 and the rotating piece 320 to each other. In some cases, the control unit 600 may be connected to the drive motor 310 through one or more wires or through a wireless communication. The cam 321 may protrude from the outer surface of the rotating piece 320 in one or more directions such as left/right directions or up/down directions. The cam 321 may contact a portion of the unlocking device L.

The drive motor 310 may be operated by the driving signal from the control unit 600 to rotate the rotating piece 320, where, as the rotating piece 320 rotates, an outer circumferential surface of the cam 321 contacts and pushes the unlocking device L.

The shape of the cam 321 may include the shape depicted in this application, but not be limited to those shapes. For example, any structure that can convert a rotational motion to a linear motion may be used instead of the cam 321 regardless of the shape or components. In some examples, the rotating piece 320 including the cam 321 may have an oval shape.

Figure 2:
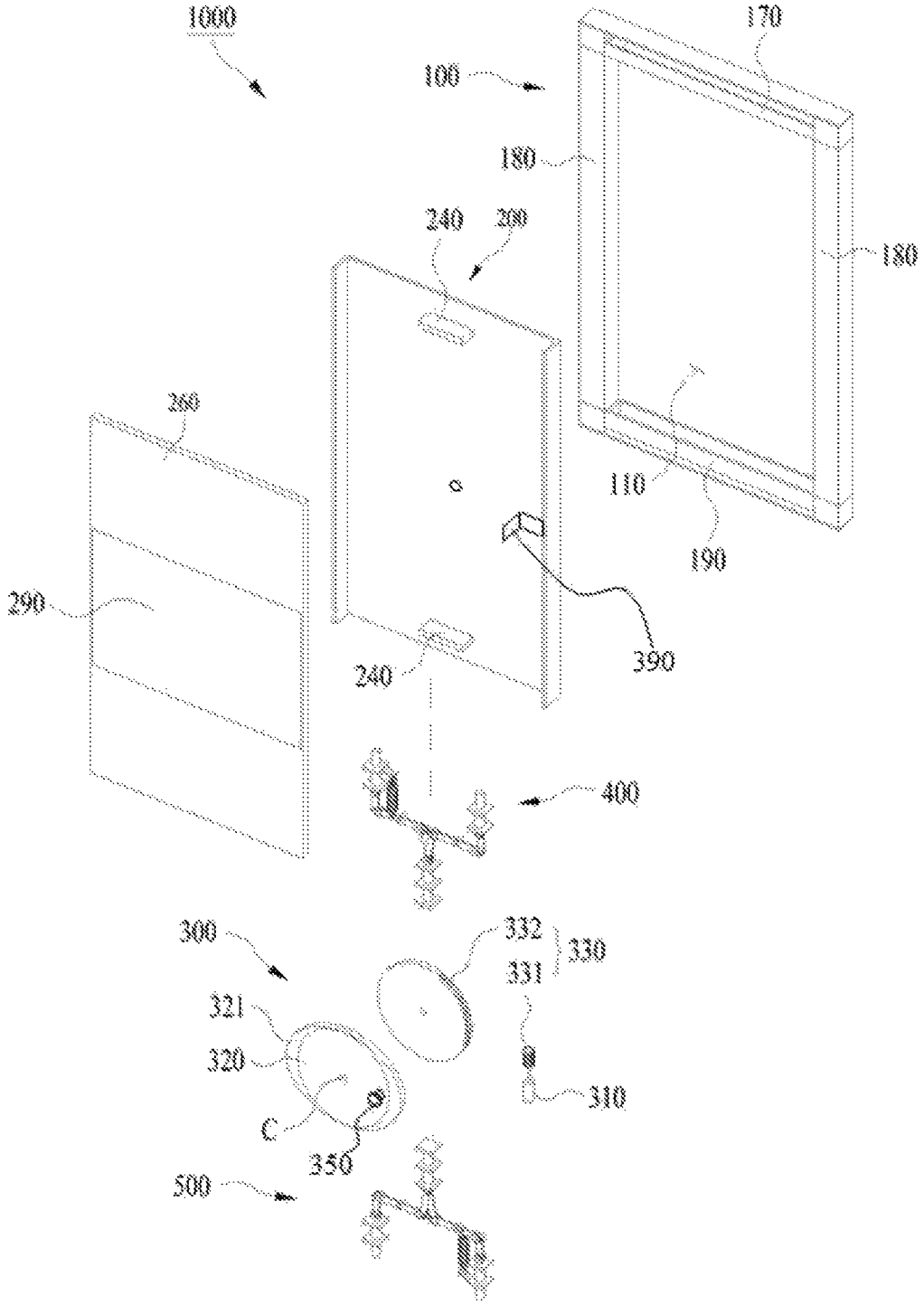
FIG. 2 is an exploded perspective view illustrating an example emergency escape apparatus.
Figure 7:
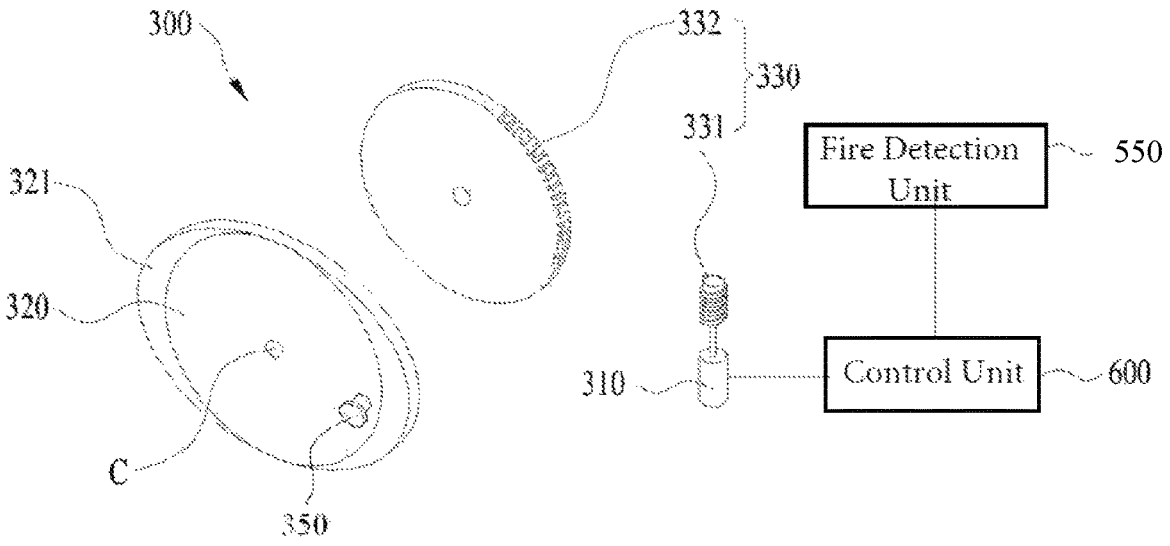
FIG. 7 is a diagram showing an example driving unit configured to operate an example emergency escape apparatus.

In some implementations, the power transmission unit 330 may include, as shown in FIGS. 1, 2, and 7, a worm 331 and worm gear 332.

In some examples, the drive motor 310 may be driven to rotate the worm 331, and the worm gear 332 engaged with the worm 331 simultaneously rotates with the worm 331. The rotating piece 320 coupled to the worm gear 332 may be rotated based on rotation of the worm gear 332, and the cam 321 located at the rotating piece 320 may push the unlocking device L.

In other examples, the power transmission unit 330 may be implemented in various other configurations.

The fire detection unit 550 may include a temperature sensor, a gas sensor, or a fire detection apparatus via a camera.

As described above, the escape door 200 has the accommodation space 250 that accommodates the driving unit 300 and the unlocking device L.

In some cases, the escape door 200 may define the accommodation space 250 in a form of a box like structure having a rectangular cross-sectional shape.

In some cases, the upper and lower ends of the escape door 200 may define an opening, through which locking and releasing operations between the unlocking device L and the support frame 100 may be possible.

In some implementations, the unlocking device L may include a first unlocking part 400 located at an upper side of the driving unit 300 and a second unlocking part 500 located at a lower side of the driving unit 300.

The first unlocking part 400 includes a first pushing rod 410 that extends in an upward direction from an upper part of the driving unit 300, a first latching rod 420 that descends in accordance with the first pushing rod 410, a first link assembly 430 that mechanically connects the first pushing rod 410 with the first latching rod 420. The first unlocking part 400 may further include a first spring S1 that elastically connects the first link assembly 430 and the escape door 200.

In some examples, the first latching rod 420 may be coupled to the upper latching part 170 of the support frame 100 and held in a state inserted into a latching groove 120 defined at the upper latching part 170. When the escape door 200 is opened, the first latching rod 420 is released from the latching groove 120.

In some cases, the upper latching part 170 of the support frame 100 may be installed on the side 180 of the support frame 100.

The first latching rod 420 may include a pair of left and right latching rods with respect to the first pushing rod 410. The pair of first latching rods 420 can be lowered down at the same time.

The escape door 200 with respect to the support frame 100 enables it to become a stable foundation accordingly.

The first link assembly 430 connects the first pushing rod 410 and two first latching rods 420, respectively, and relays movement (e.g., an upward movement or a downward movement) of the first pushing rod 410 to the first latching rod 420.

More specifically, the first link assembly 430: a pair of first pushing links 431, each of which has a first end hingedly connected to the upper end of the first pushing rod 410; a pair of first connection links 432 configured to rotate about a hinge point (P) that is installed on a rear cover of the escape door 200, where each of the first connection links 432 has one end hingedly coupled to a second end of the first pushing links 431; and a pair of first latching link 433, each of which has a first end hingedly connected to the other end of the first connection links 432 and a second end hingedly connected to a lower end of each of the first latching rods 420.

In some examples, the first spring S1 is connected between the escape door 200 and the first connection link 432 to apply restoring force in a normal state so that the escape door 200 is latched to the support frame 100.

The second unlocking part 500 is provided at a lower part of the driving unit 300, and includes a second pushing rod 510 that extends in a downward direction from the lower part of the driving unit 300, a second latching rod 520 configured to be lifted based on the second pushing rod 510 moving up, and a second link assembly 530 that mechanically connects the second latching rod 520 with the second pushing rod 510. The second unlocking part 500 may further include a second spring S2 that elastically connect the escape door 200 and the second link assembly 530 to each other.

In a normal state, the second latching rod 520 may be placed on the support frame 100 and inserted into the latching groove 120 defined at a lower latching part 190 of the support frame. When the escape door 200 is opened, the second latching rod 520 is released from the latching groove 120 at the lower latching part 190.

In some cases, the lower latching part 190 of the support frame 100 may be installed at the side 180 of the support frame 100.

The second latching rod 520 may include a pair of left and right latching rods. The pair of second latching rods 520 are configured to be raised in accordance with a descent of the second pushing rod 510.

The escape door 200 with respect to the support frame 100 enables it to be a more stable foundation accordingly.

The second link assembly 530 connects the second pushing rod 510 and the pair of second latching rods 520, respectively, and the second pushing rod 510 and the second latching rods 520 can to move up and down to connect with each other.

In some implementations, the second link assembly 530 includes: a pair of second pushing links 531, each of which has a first end hingedly connected to a lower end of the second pushing rod 510; a pair of second connection link 532 configured to rotate about a hinge point P installed on the rear cover of the escape door 200, where each of the second connection links 532 has one end hingedly coupled to a second end of the second pushing links 531; and a pair of second latching link 533, each of which has a first end hingedly connected to the other end of the second connection links 532 and a second end hingedly connected to an upper end of each of the second latching rods 520.

The second spring S2 is connected between the escape door 200 and the second connection link 532, and applies restoring force in a normal state so that the escape door 200 is latched to the support frame 100.

In some implementations, an installation direction of the emergency escape apparatus 1000 would be possible in any direction as the first unlocking part 400 and second unlocking part 500 are arranged in an up and down direction with respect to the driving unit 300 located between the first unlocking part 400 and second unlocking part 500. For example, the emergency escape apparatus 1000 may be symmetric with respect to a line passing through a center of the driving unit 300.

In some implementations, the first unlocking part 400 and the second unlocking part 500 may be operated simultaneously to decouple upper and lower portions of the escape door 200 from the support frame 100 at the same time, which facilitates escape from the building.

When the rotating piece 320 of the driving unit 300 is rotated about an axis C, the outer external surface of the cam 321 pushes the first pushing rod 410 and the second pushing rod 510 of the unlocking device L to separate the escape door 200 from the support frame 100, where the exit opening 110 of the support frame 10 is open.

In some examples, the escape door 200 may include a detachable access part 290 that is installed on a front cover of the escape door 200 that faces an inside of the building and that covers a handle 350 located at a front of the rotating piece 320.

The handle 350 may be manually rotated by a user to detach the escape door 200 from the support frame 100, for example, when a fire is detected by the user rather than the fire detection unit 550 or when the fire detection unit 550 or the control unit 600 does not operate properly. For example, the access part 290 may be hit to access the handle 350 to rotate the driving unit 300.

In some cases, the drive motor 310 is moved to one point of the back wall of the escape door 200 and enables the hinge to move, and press the plate spring 390 and torsion springs to then press the worm 331 and worm gear 332 to interlock.

Therefore, the worm 331 and drive motor 310 when the manually operated rotates the one point by pressurize against the plate spring 390 and separates the worm 331 and the worm gear 332, at which point, the rotating handle 350 is turned to separate the escape door 200 from the support frame 100.

When the mentioned drive motor 310 is rotated centered on the point of the escape door 200 instead of being hinged, it enables worm 331 and the worm gear 332 to detach alongside the linear guard.

Additionally, it is comprised to prevent inside the first link assembly 430 and the inner side of second link assembly 530 building wall from damaged when coming in contact of link assemblies 430, 530 of the front cover 260 and is for such purposes.

In some implementations, the escape door 200 may include a guide bracket 270 located at the rear cover of the escape door 200 and configured to guide movement of first pushing rod 410 and the second pushing rod 510 and movement of the first latching rod 420 and the second latching rod 520, where the guide bracket 270 defines a guide hole. In some examples, the guide bracket 270 includes a plurality of guide brackets 270 that respectively guide movement of first pushing rod 410, the second pushing rod 510, the first latching rod 420, and the second latching rod 520.

The emergency escape apparatus 1000 may be used as an emergency escape hatch, or may be part of an indoor wall connected to an external emergency stairway.

In some implementations, the escape door 200 and the support frame 100 are connected by one or more wires to prevent a separated escape door 200 from falling to an outside of the building.

Hereinafter, the operation of the emergency escape apparatus 1000 with reference to FIGS. 1 to 8 attached hereto will be described.

Figure 3:
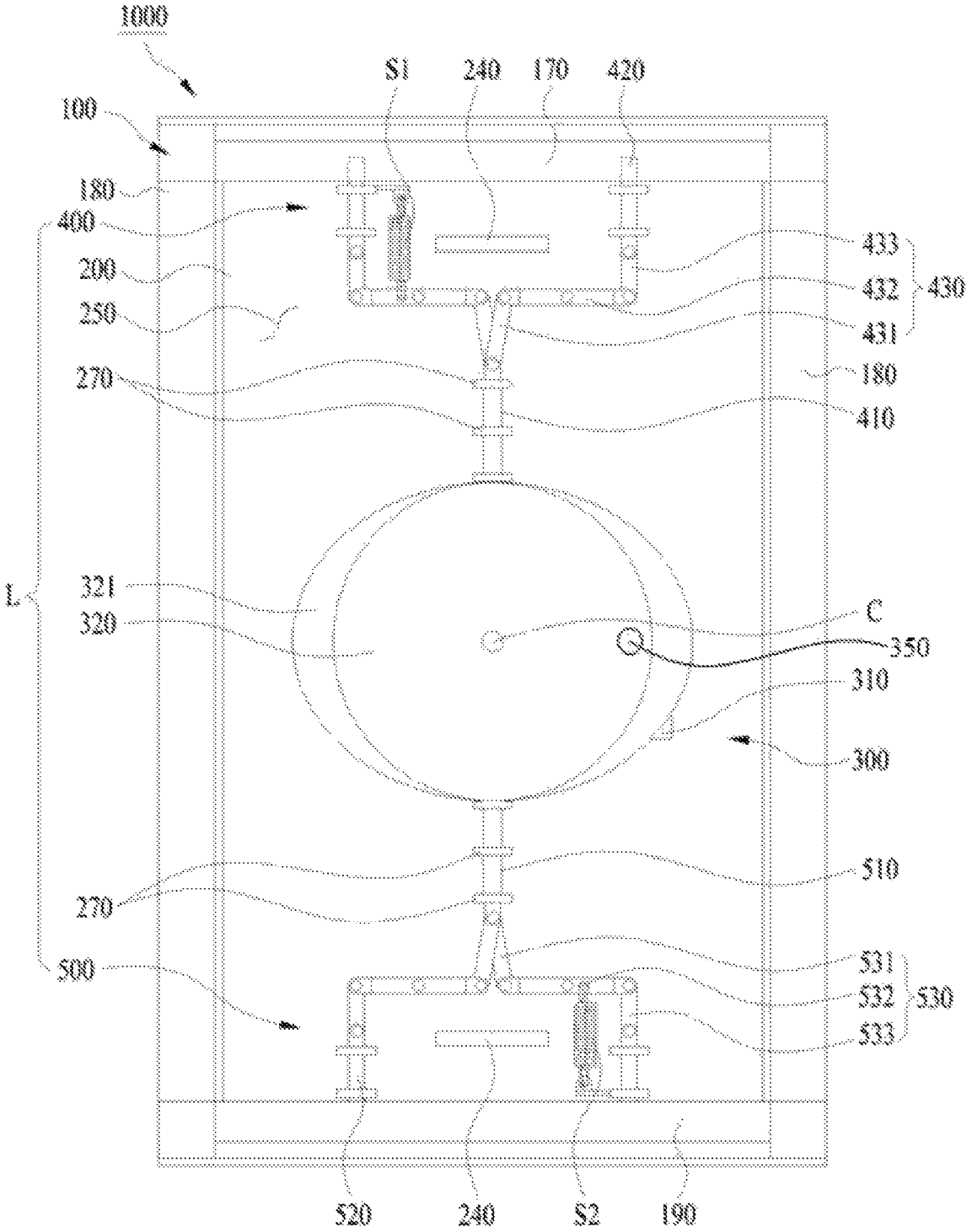
FIG. 3 is a front view illustrating an example emergency escape apparatus.
Figure 4:
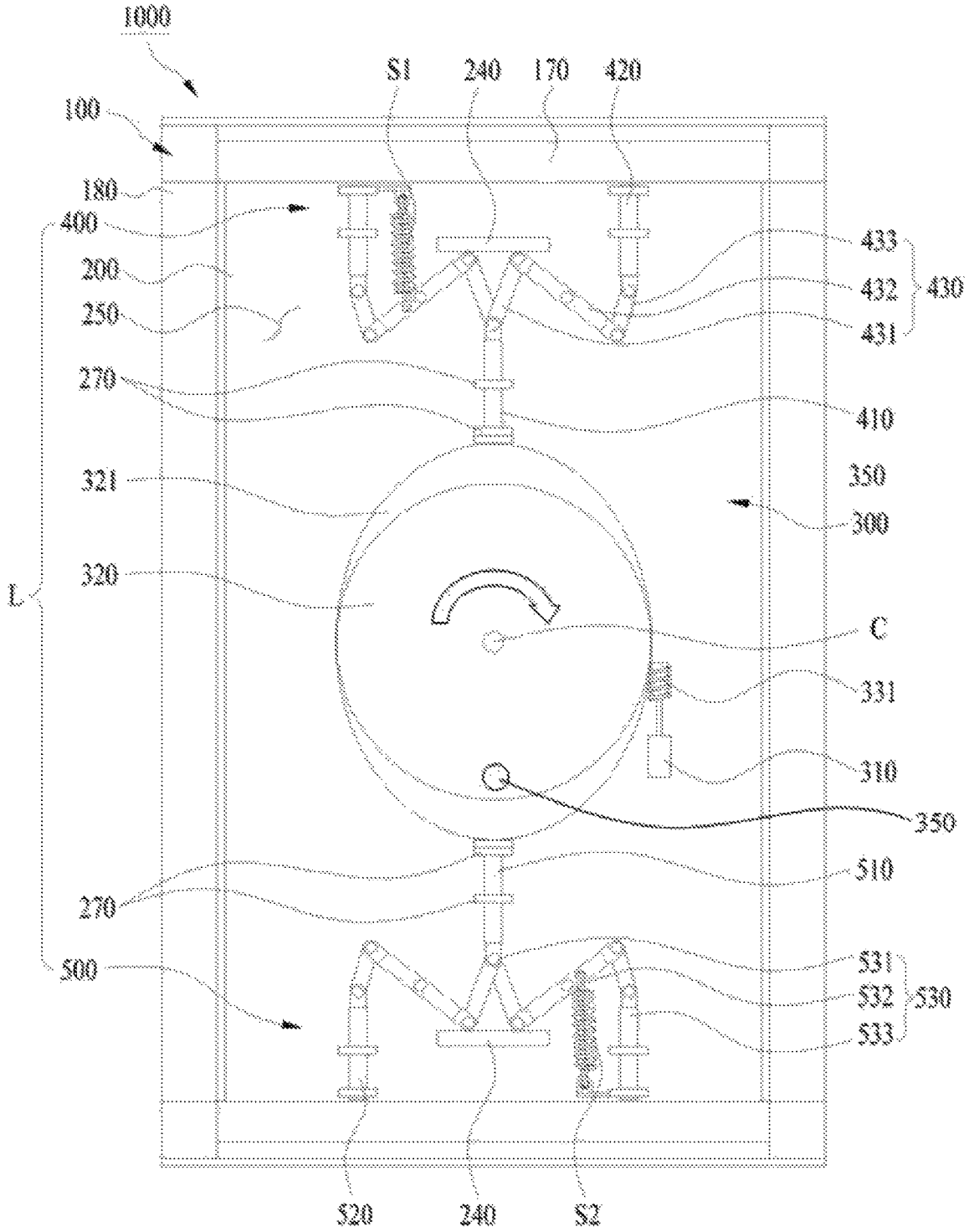
FIG. 4 is a front view illustrating an example emergency escape apparatus.
Figure 5:
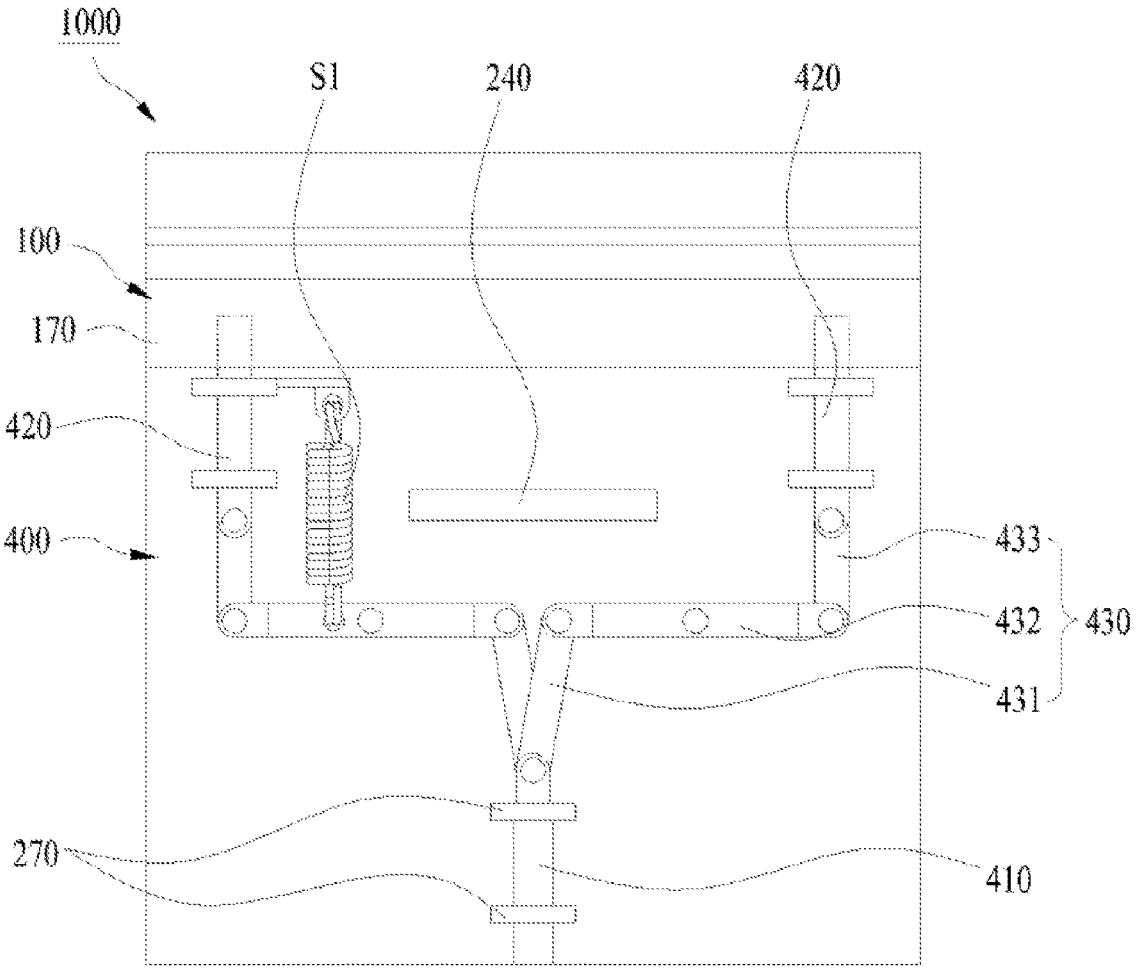
FIG. 5 shows an enlarged front view illustrating an example emergency escape apparatus.
Figure 6:
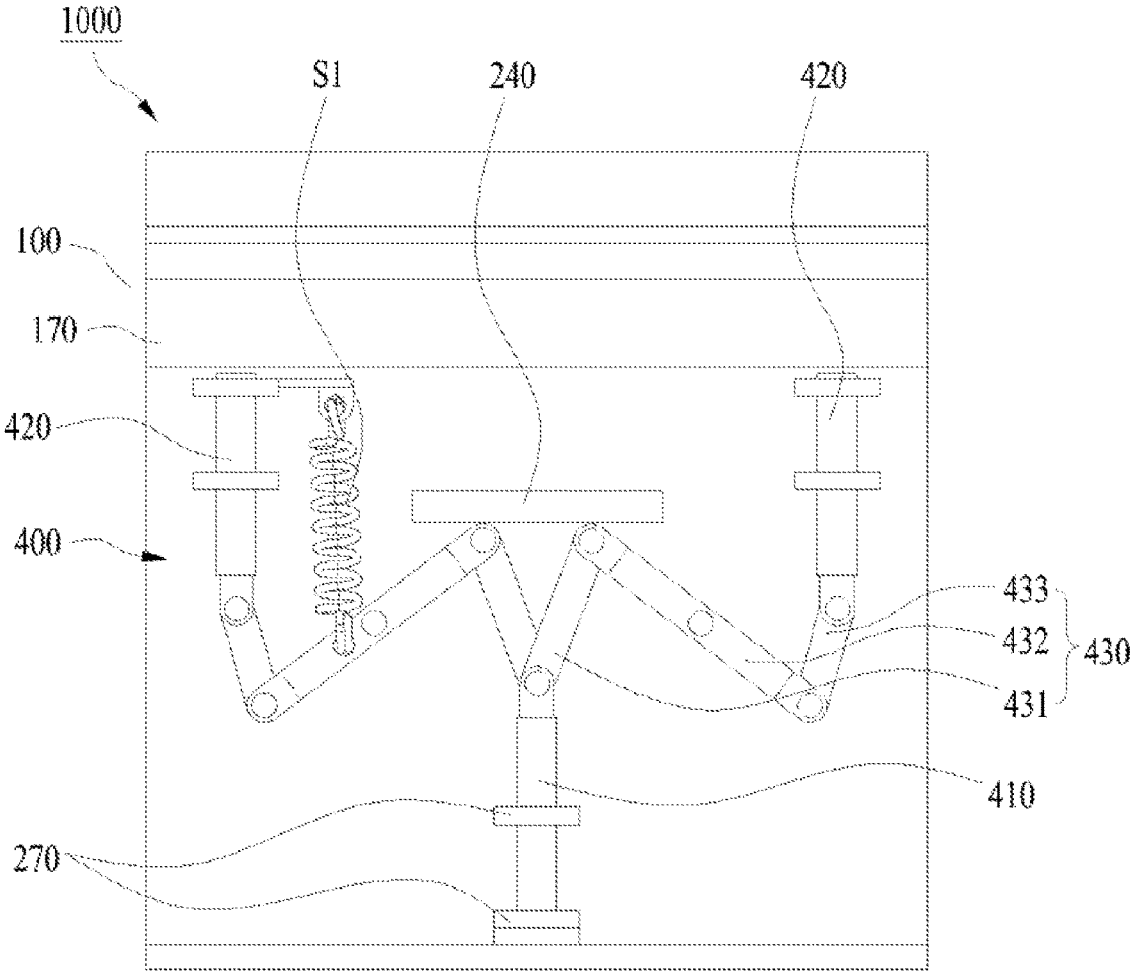
FIG. 6 shows an enlarged view illustrating an example emergency escape apparatus in an opened state.

As shown in FIG. 3 and FIG. 5, the escape door 200 is in a normal state latched to the support frame 100.

Specifically, the first latching rods 420 maintain, based on tension of the first spring S1 connected to the pair of first latching links 433 of the first link assembly, a raised state in which the first latching rod 420*s* are latched to the latching groove 120 defined at an upper portion of the support frame 100, and the second latching rod 520 maintain, based on tension of the second spring S2, a lowered state in which the second latching rods 520 are latched to the latching groove defined at a lower portion of the support frame 100. In this latched state, the escape door 200 is not detached from the support frame 100, for example, in a front-back direction.

In other words, when the first unlocking part 400 and the second unlocking part 500, which are installed in the escape door 200, are latched to the support frame 100, the escape door 200 is not detached from the support frame 100.

In some implementations, the fire detection unit 550, as shown in FIG. 7, when a fire in the building is detected, may transmit a signal to the driving unit 300 by the control unit 600, and trigger the drive motor 310 to operate the rotating piece 320 to be rotated by the power transmission unit 330. In some cases, the fire detection unit 550 may be included in the control unit 600. In some cases, the fire detection unit 550 may be connected to the control unit 600 through one or more wires or through a wireless communication. In some cases, the emergency escape apparatus 1000 may include at least one of a fire detector such as the fire detection unit 550 or a controller such as the control unit 600. In some cases, the fire detector and the controller may be provided at the building and the emergency escape apparatus 1000 may be connected to the fire detector and the controller of the building.

The first pushing rod 410 may be placed on an upper side of driving unit 300, which includes a cam 321 located at the rotating piece 320, and the rotating piece 320 pushes the first and second pushing rods 410, 510, respectively, up and down simultaneously.

The first pushing links 431, which are branched from the first pushing rod 410 in left and right sides of the first pushing rod 410 and configured to hingedly move about the first pushing rod 410, may move upward to cause the pair of first connection links 432 to rotate about the hinge point P in opposite directions to each other. For example, one of the pair of connection links 432 may rotate in a clockwise direction about a first hinge point, and the other of the pair of connection links 432 may rotate in a counterclockwise direction about a second hinge point based on the first pushing links 431 moving together in the upward direction. Each of the first hinge point and the second hinge point may be located between ends of each one of the pair of connection links 432.

At the same time, the second pushing links 531, which are branched from the second pushing rod 510 in left and right sides of the second pushing rod 510 and configured to hingedly move about the second pushing rod 510, may move downward to cause the pair of second connection links 532 to rotate about a hinge point P in opposite directions to each other.

Therefore, the first latching links 433 connected to an outer end of the first connection links 432 moves downward to release the first latching rod 420 from the latching groove 120 defined at the upper portion of the support frame, and, at the same time, the second latching link 533 connected to an outer end of the second connection links 532 moves upward to release a second latching rod 520 from the latching groove 120 defined at the lower portion of the support frame 100.

Figure 8:
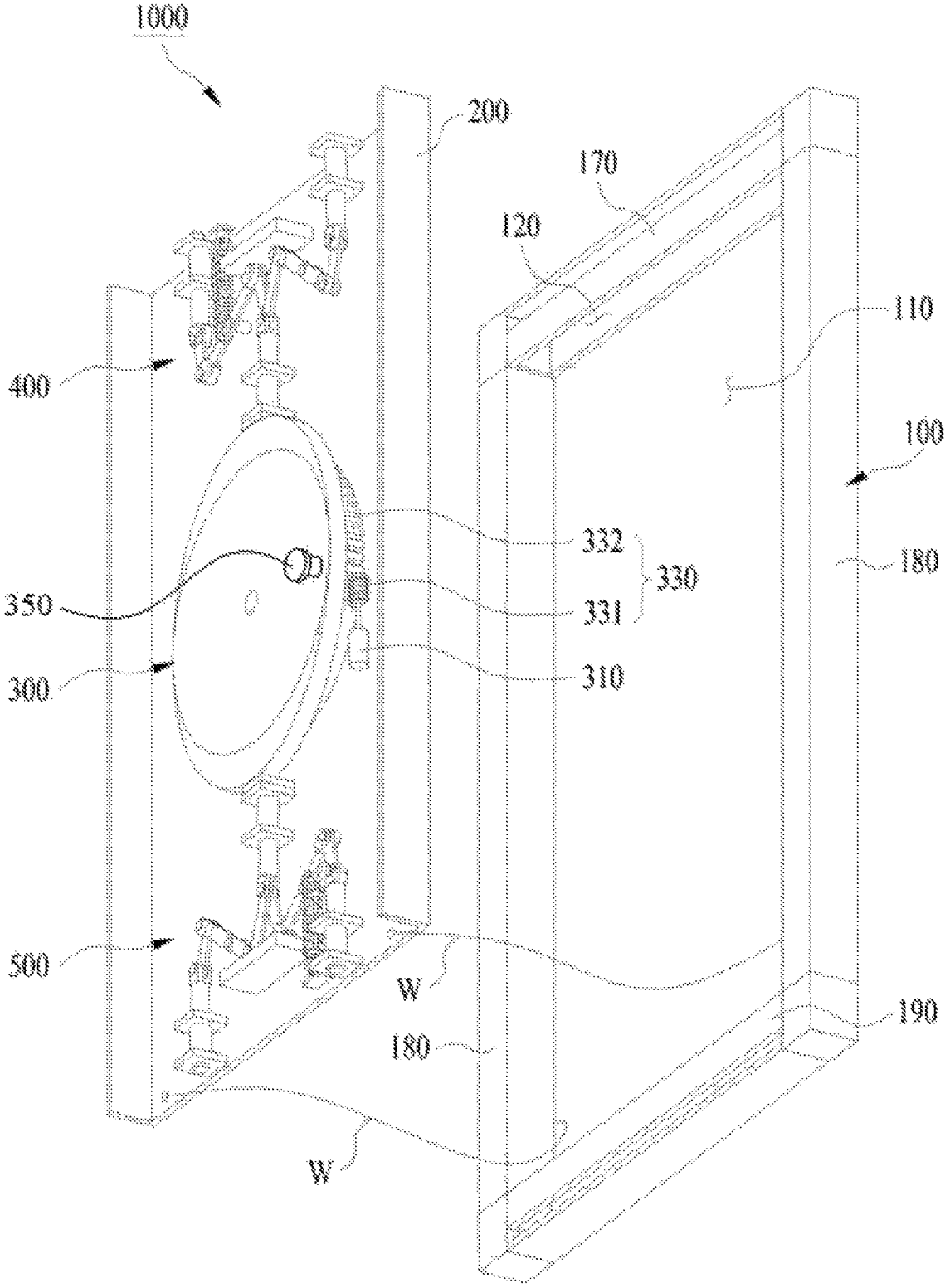
FIG. 8 is a side perspective view illustrating an example emergency escape apparatus in an open state.

As a result, the escape door 200 is separated from the support frame 100, as shown in FIG. 8, and when escape door 200 is pushed from the support frame 100 and the emergency escape apparatus 1000 of the building may completely open the exit opening 110.

Therefore, people may quickly escape from the building through the exit opening 110 of the support frame 100.

The implementations of the present disclosure are merely illustrative but for those with technical background in the art, the aforementioned scope of claims can vary in form and details depending on other exemplified fields applied.

What is claimed is:

1. An emergency escape apparatus comprising:

a support frame configured to be installed on a door or a wall, the support frame defining an exit opening;

an escape door located inside the exit opening and configured to open and close the exit opening, the escape door defining an accommodation space;

a driving unit located in the accommodation space of the escape door and configured to rotate relative to the escape door, the driving unit comprising:

a rotating piece rotatably coupled to the escape door and configured to rotate about an axis perpendicular to a front surface of the escape door, and a cam that protrudes outward from an outer circumference of the rotating piece with respect to the axis; and an unlocking device that is located in the accommodation space of the escape door, that is configured to be pushed by the cam, and that is configured to release coupling between the escape door and the support frame based on rotation of the driving unit, wherein the driving unit is configured to be controlled by a control unit based on a sensor detecting an event.

2. The emergency escape apparatus of claim 1, wherein the unlocking device comprises a first unlocking part located at an upper side of the driving unit and a second unlocking part located at a lower side of the driving unit, wherein the first unlocking part comprises:

a first pushing rod that extends in an upward direction from the upper side of the driving unit and that is configured to move upward based on being pushed by the upper side of the driving unit;

a first latching rod configured to move downward to be released from the support frame based on the first pushing rod moving upward;

a first link assembly that connects the first pushing rod and the first latching rod to each other; and a first spring that connects the escape door and the first link assembly to each other, and wherein the second unlocking part comprises:

a second pushing rod that extends in a downward direction from the lower side of the driving unit and that is configured to move downward based on being pushed by the lower side of the driving unit;

a second latching rod configured to move upward to be released from the support frame based on the second pushing rod moving downward;

a second link assembly that connects the second pushing rod and the second latching rod to each other; and a second spring that connects the escape door and the second link assembly to each other.

3. The emergency escape apparatus of claim 2, wherein the first latching rod comprises a pair of first latching rods that are located at a first lateral side and a second lateral side with respect to the first pushing rod, respectively, the pair of first latching rods being configured to move downward together based on the first pushing rod moving upward, and wherein the second latching rod comprises a pair of second latching rods that are located at the first lateral side of the second pushing rod and the second lateral side with respect to the second pushing rod, the pair of second latching rods being configured to move upward together based on the second pushing rod moving downward.

4. The emergency escape apparatus of claim 3, wherein the first link assembly comprises:

a pair of first pushing links, each of the pair of first pushing links having a first end connected to an upper end of the first pushing rod;

a pair of first connection links, each of the pair of first connection links being configured to rotate about a first hinge axis positioned at a rear cover of the escape door, and having a first end connected to a second end of one of the pair of first pushing links; and a pair of first latching links, each of the pair of first latching links having a first end connected to the first end of one of the pair of first connection links, and a second end connected to a lower end of one of the pair of first latching rods, and wherein the second link assembly comprises:

a pair of second pushing links, each of the pair of second pushing links having a first end connected to a lower end of the second pushing rod, a pair of second connection links, each of the pair of second connection links being configured to rotate about a second hinge axis positioned at the rear cover of the escape door, and having a first end connected to a second end of one of the pair of second pushing links, and a pair of second latching links, each of the pair of second latching links having a first end connected to the first end of one of the pair of second connection links, and a second end connected to an upper end of one of the pair of second latching rods.

5. The emergency escape apparatus of claim 2, wherein the driving unit comprises:

a drive motor connected to the control unit and configured to rotate the rotating piece; and a power transmission unit that connects the drive motor to the rotating piece.

6. The emergency escape apparatus of claim 5, wherein the cam is attached to the rotating piece, or the rotating piece includes the cam, and wherein the cam and the rotating piece are configured to rotate together about the axis to thereby push both of the first pushing rod and the second pushing rod simultaneously.

7. The emergency escape apparatus of claim 5, wherein the driving unit further comprises a handle located at a front surface of the rotating piece, and wherein the escape door comprises a front cover that is configured to face an interior area and the handle, the front cover comprising an access part that allows a user to access the handle to rotate the driving unit.

8. The emergency escape apparatus of claim 5, further comprising one or more wires that connect the escape door and the support frame to each other.

9. The emergency escape apparatus of claim 5, wherein the rotating piece and the cam define an oval shape that contacts a lower end of the first pushing rod and an upper end of the second pushing rod.

10. The emergency escape apparatus of claim 9, wherein the rotating piece is located between the lower end of the first pushing rod and the upper end of the second pushing rod.

11. The emergency escape apparatus of claim 5, wherein the power transmission unit comprises a worm gear connected to the drive motor.

12. The emergency escape apparatus of claim 4, wherein the driving unit is configured to rotate about a rotation shaft located at the rear cover of the escape door.

13. The emergency escape apparatus of claim 1, comprising the control unit and the sensor that is connected to the control unit.

14. The emergency escape apparatus of claim 1, wherein the control unit and the sensor are configured to be installed at a building, and wherein the driving unit is configured to communicate with the control unit.

15. The emergency escape apparatus of claim 2, wherein the first unlocking part and the second unlocking part are symmetric with respect to a line passing through a center of the driving unit.

16. The emergency escape apparatus of claim 1, wherein the sensor comprises a fire detector, a gas detector, a temperature sensor, or a camera.

17. The emergency escape apparatus of claim 1, wherein the rotating piece and the cam define an oval shape having a first width along a first axis and a second width along a second axis, the first axis and the second axis being orthogonal to each other and passing through a center of the rotating piece, and wherein the second width is greater than the first width, and a diameter of the rotating piece is equal to the first width.

18. The emergency escape apparatus of claim 17, wherein the driving unit further comprises a handle located at a front surface of the rotating piece, the handle being located on the first axis or the second axis and protruding toward the front surface of the escape door.

19. The emergency escape apparatus of claim 1, wherein the cam defines an outermost boundary of the driving unit, the outermost boundary being in contact with an end of the unlocking device, and wherein a portion of the outermost boundary overlaps with the outer circumference of the rotating piece.

20. The emergency escape apparatus of claim 19, wherein the rotating piece includes the cam, or the cam is attached to the outer circumference of the rotating piece.

* * * * *